US011980229B2

(12) United States Patent
Park et al.

(10) Patent No.: US 11,980,229 B2
(45) Date of Patent: May 14, 2024

(54) AEROSOL GENERATING SYSTEM

(71) Applicant: KT&G CORPORATION, Daejeon (KR)

(72) Inventors: In Su Park, Seoul (KR); Sung Jong Ki, Daejeon (KR); Young Joong Kim, Daejeon (KR); Jang Won Seo, Daejeon (KR); John Tae Lee, Daejeon (KR); Sun Hwan Jung, Daejeon (KR); Eun Mi Jeoung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 144 days.

(21) Appl. No.: 17/047,154

(22) PCT Filed: Jun. 24, 2020

(86) PCT No.: PCT/KR2020/008128
§ 371 (c)(1),
(2) Date: Oct. 13, 2020

(87) PCT Pub. No.: WO2021/025286
PCT Pub. Date: Feb. 11, 2021

(65) Prior Publication Data

US 2022/0408820 A1 Dec. 29, 2022

(30) Foreign Application Priority Data

Aug. 8, 2019 (KR) ..... 10-2019-0096909

(51) Int. Cl.
*A24F 40/465* (2020.01)
*A24F 40/20* (2020.01)

(52) U.S. Cl.
CPC ..... *A24F 40/465* (2020.01); *A24F 40/20* (2020.01)

(58) Field of Classification Search
None
See application file for complete search history.

(56) References Cited

U.S. PATENT DOCUMENTS 7,022,952 B2 4/2006 de Rooij et al.
10,159,283 B2 12/2018 Mironov
(Continued)

FOREIGN PATENT DOCUMENTS

CN 102014995 A 4/2011
EP 0337507 A2 * 10/1989
(Continued)

OTHER PUBLICATIONS

Office Action dated Jun. 21, 2022 from the Japanese Patent Office in JP Application No. 2020-567894.
(Continued)

*Primary Examiner* — Felix O Figueroa
(74) *Attorney, Agent, or Firm* — Sughrue Mion, PLLC

(57) ABSTRACT

An aerosol generating system includes: a cavity configured to accommodate at least a portion of a cigarette; a first induction coil located around the cavity; a second induction coil located around the cavity and connected to the first induction coil in parallel; and a battery configured to supply an alternating current to the first induction coil and the second induction coil, wherein the first induction coil and the second induction coil have different resonant frequencies.

12 Claims, 11 Drawing Sheets

(56) References Cited

U.S. PATENT DOCUMENTS

| | | | | |
|---|---|---|---|---|
| 10,668,058 | B2 | 6/2020 | Rose et al. | |
| 11,000,073 | B2 | 5/2021 | Hu et al. | |
| 11,240,885 | B2 | 2/2022 | Fursa et al. | |
| 11,375,754 | B2 * | 7/2022 | Batista | H05B 6/105 |
| 11,470,883 | B2 * | 10/2022 | Kaufman | H05B 6/108 |
| 11,477,861 | B2 * | 10/2022 | Mironov | H05B 6/108 |
| 2016/0227839 | A1 | 8/2016 | Zuber et al. | |
| 2017/0055582 | A1 | 3/2017 | Blandino et al. | |
| 2018/0317552 | A1 | 11/2018 | Kaufman et al. | |
| 2019/0124988 | A1 | 5/2019 | Hu et al. | |
| 2019/0313695 | A1 | 10/2019 | Kaufman et al. | |
| 2021/0227874 | A1 * | 7/2021 | Rogan | A24D 1/20 |
| 2022/0142253 | A1 * | 5/2022 | Sayed | A24F 40/40 |

FOREIGN PATENT DOCUMENTS

| | | | |
|---|---|---|---|
| JP | 2018-530311 | A | 10/2018 |
| JP | 2019-110895 | A | 7/2019 |
| KR | 10-2005-0083035 | A | 8/2005 |
| KR | 10-2017-0007262 | A | 1/2017 |
| KR | 10-2018-0014090 | A | 2/2018 |
| KR | 10-2018-0059916 | A | 6/2018 |
| KR | 10-2019-0039713 | A | 4/2019 |
| KR | 10-2019-0047092 | A | 5/2019 |
| WO | 2017/001819 | A1 | 2/2017 |
| WO | 2017194769 | A1 | 11/2017 |
| WO | 2018073376 | A1 | 4/2018 |
| WO | 2018178113 | A2 | 10/2018 |
| WO | 2018/206616 | A1 | 11/2018 |
| WO | 2019/030170 | A1 | 2/2019 |
| WO | 2019/030353 | A1 | 2/2019 |
| WO | 2019/030364 | A1 | 2/2019 |
| WO | 2019/073239 | A1 | 4/2019 |

OTHER PUBLICATIONS

Office action dated Apr. 7, 2023 issued in Chinese App. No. 202080002241.3.

International Search Report dated Oct. 12, 2020 from the Korean Intellectual Property Office in Application No. PCT/KR2020/008128.

Office Action dated Nov. 17, 2021 in Korean Application No. 10-2019-0096909.

Extended European Search Report dated Dec. 22, 2021 in EP 20781425.2.

Office Action dated Jan. 4, 2022 in Japanese Application No. 2020-567894.

* cited by examiner

AEROSOL GENERATING SYSTEM

TECHNICAL FIELD

One or more embodiments relate to an aerosol generating system.

BACKGROUND ART

Recently, the demand for alternatives for traditional combustive cigarettes has increased. For example, there is growing demand for aerosol generating devices which generate aerosol by heating an aerosol generating material, rather than by combusting cigarettes.

Recently, an induction heating method using an induction coil and a susceptor is widely used to heat an aerosol generating material. Also, some aerosol generating devices generate aerosol by simultaneously heating a plurality of materials (or a plurality of areas) to improve a taste and/or amount of vapor.

Therefore, there is a need for a technique for heating a plurality of materials (or a plurality of areas) at different temperatures by using an induction heating method.

DISCLOSURE OF INVENTION

Solution to Problem

According to one or more embodiments, an aerosol generating system includes: a cavity accommodating at least a portion of a cigarette; a first induction coil located around the cavity; a second induction coil located around the cavity and connected to the first induction coil in parallel; and a battery supplying an alternating current to the first induction coil and the second induction coil, wherein the first induction coil and the second induction coil have different resonant frequencies.

According to one or more embodiments, an aerosol generating device includes: a first induction coil; a second induction coil connected to the first induction coil in parallel; and a battery supplying an alternating current to the first induction coil and the second induction coil, wherein the first induction coil and the second induction coil have different resonant frequencies.

Advantageous Effects of Invention

According to one or more embodiments, a heater structure capable of heating a plurality of materials and/or a plurality of areas at different temperatures may be provided by introducing an induction heating method using a single susceptor and a plurality of induction coils having different resonant frequencies.

BEST MODE FOR CARRYING OUT THE INVENTION

Figure 1:
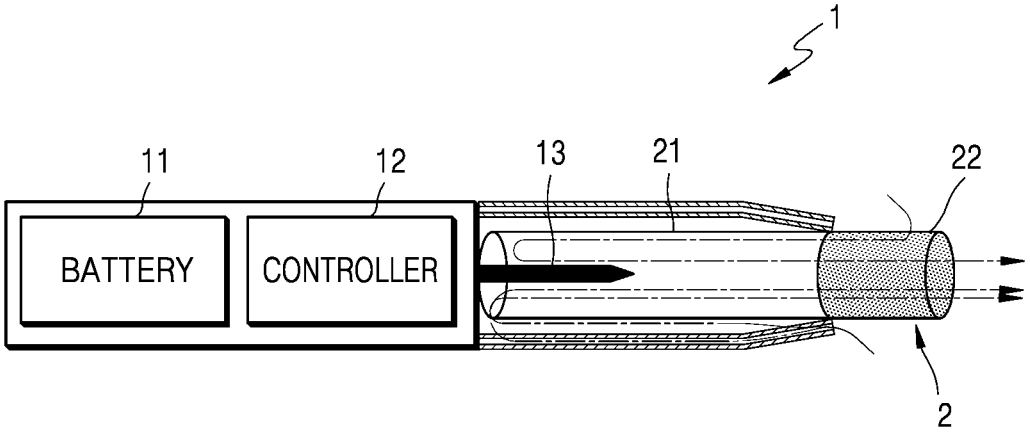
FIGS. 1 through 3 are diagrams showing examples in which a cigarette is inserted into an aerosol generating device.

According to one or more embodiments, an aerosol generating system includes: a cavity accommodating at least a portion of a cigarette; a first induction coil located around the cavity; a second induction coil located around the cavity and connected to the first induction coil in parallel; and a battery supplying an alternating current to the first induction coil and the second induction coil, wherein the first induction coil and the second induction coil have different resonant frequencies.

MODE FOR THE INVENTION

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used may be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

In the following embodiments, the terms "upstream" and "downstream" may indicate relative locations of segments constituting a cigarette. A cigarette includes an upstream end (i.e., a portion through which air is introduced) and a downstream end (i.e., a portion through which air is discharged) opposite to the upstream end. When using the cigarette, a user may hold the downstream end by the mouth.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, one or more embodiments will be described in detail with reference to the accompanying drawings.

Figure 2:
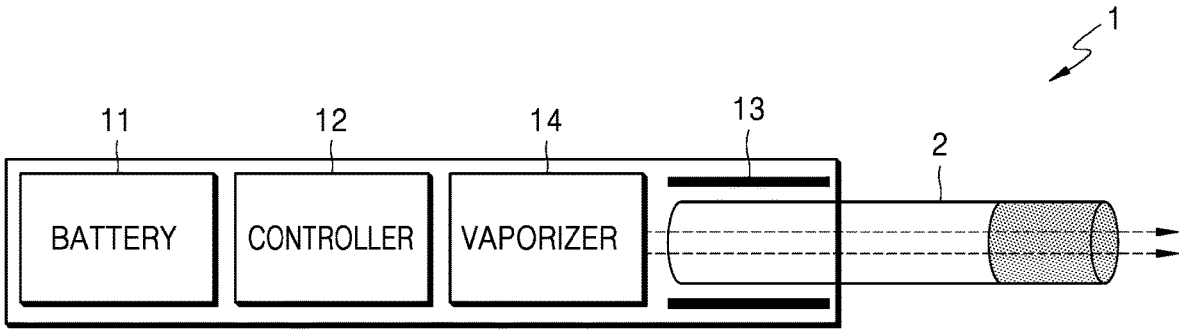
Figure 3:
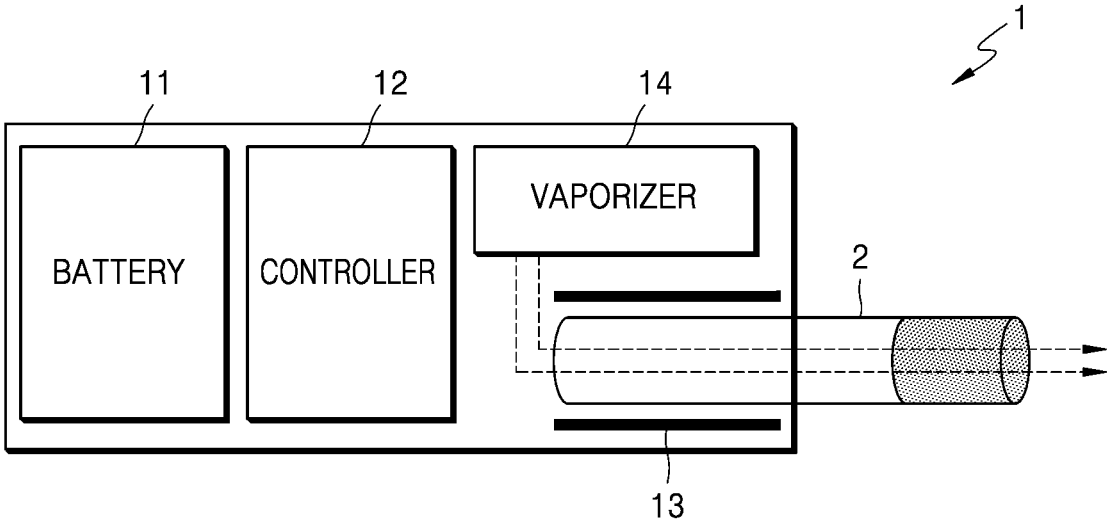

FIGS. 1 through 3 are diagrams showing examples in which a cigarette is inserted into an aerosol generating device.

Referring to FIG. 1, the aerosol generating device 1 may include a battery 11, a controller 12, and a heater 13. Referring to FIGS. 2 and 3, the aerosol generating device 1 may further include a vaporizer 14. Also, the cigarette 2 may be inserted into an inner space of the aerosol generating device 1.

FIGS. 1 through 3 illustrate components of the aerosol generating device 1, which are related to the present embodiment. Therefore, it will be understood by one of ordinary skill in the art related to the present embodiment that other general-purpose components may be further included in the aerosol generating device 1, in addition to the components illustrated in FIGS. 1 through 3.

Also, FIGS. 2 and 3 illustrate that the aerosol generating device 1 includes the heater 13. However, as necessary, the heater 13 may be omitted.

FIG. 1 illustrates that the battery 11, the controller 12, and the heater 130 are arranged in series. Also, FIG. 2 illustrates that the battery 11, the controller 12, the vaporizer 14, and the heater 13 are arranged in series. Also, FIG. 3 illustrates that the vaporizer 14 and the heater 13 are arranged in parallel. However, the internal structure of the aerosol generating device 1 is not limited to the structures illustrated in FIGS. 1 through 3. In other words, according to the design of the aerosol generating device 1, the battery 11, the controller 12, the heater 13, and the vaporizer 14 may be differently arranged.

When the cigarette 2 is inserted into the aerosol generating device 1, the aerosol generating device 1 may operate the heater 13 and/or the vaporizer 14 to generate an aerosol. The aerosol generated by the heater 13 and/or the vaporizer 14 is delivered to a user by passing through the cigarette 2.

As necessary, even when the cigarette 2 is not inserted into the aerosol generating device 1, the aerosol generating device 1 may heat the heater 13.

The battery 11 may supply power to be used for the aerosol generating device 1 to operate. For example, the battery 11 may supply power to heat the heater 13 or the vaporizer 14, and may supply power for operating the controller 12. Also, the battery 11 may supply power for operations of a display, a sensor, a motor, etc. mounted in the aerosol generating device 1.

The controller 12 may generally control operations of the aerosol generating device 1. In detail, the controller 12 may control not only operations of the battery 11, the heater 13, and the vaporizer 14, but also operations of other components included in the aerosol generating device 1. Also, the controller 12 may check a state of each of the components of the aerosol generating device 1 to determine whether or not the aerosol generating device 1 is able to operate.

The controller 12 may include at least one processor. A processor can be implemented as an array of a plurality of logic gates or can be implemented as a combination of a microprocessor and a memory in which a program executable in the microprocessor is stored. It will be understood by one of ordinary skill in the art that the processor can be implemented in other forms of hardware.

The heater 13 may be heated by the power supplied from the battery 11. For example, when the cigarette 2 is inserted into the aerosol generating device 1, the heater 13 may be located outside the cigarette 2. Thus, the heated heater 13 may increase a temperature of an aerosol generating material in the cigarette 2.

The heater 13 may include an electro-resistive heater. For example, the heater 13 may include an electrically conductive track, and the heater 13 may be heated when currents flow through the electrically conductive track. However, the heater 13 is not limited to the example described above and may include all heaters which may be heated to a desired temperature. Here, the desired temperature may be pre-set in the aerosol generating device 1 or may be set as a temperature desired by a user.

As another example, the heater 13 may include an induction heater. In detail, the heater 13 may include an induction coil for heating a cigarette in an induction heating method, and the cigarette may include a susceptor which may be heated by the induction heater.

For example, the heater 13 may include a tube-type heating element, a plate-type heating element, a needle-type heating element, or a rod-type heating element, and may heat the inside or the outside of the cigarette 2, according to the shape of the heating element.

Also, the aerosol generating device 1 may include a plurality of heaters 13. Here, the plurality of heaters 13 may be inserted into the cigarette 2 or may be arranged outside the cigarette 2. Also, some of the plurality of heaters 13 may be inserted into the cigarette 2 and the others may be arranged outside the cigarette 2. In addition, the shape of the heater 13 is not limited to the shapes illustrated in FIGS. 1 through 3 and may include various shapes.

The vaporizer 14 may generate aerosol by heating a liquid composition and the generated aerosol may pass through the cigarette 2 to be delivered to a user. In other words, the aerosol generated via the vaporizer 14 may move along an air flow passage of the aerosol generating device 1 and the air flow passage may be configured such that the aerosol generated via the vaporizer 14 passes through the cigarette 2 to be delivered to the user.

For example, the vaporizer 14 may include a liquid storage, a liquid delivery element, and a heating element, but it is not limited thereto. For example, the liquid storage, the liquid delivery element, and the heating element may be included in the aerosol generating device 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 14 or may be formed integrally with the vaporizer 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14 may be referred to as a cartomizer or an atomizer, but it is not limited thereto.

The aerosol generating device 1 may further include other components in addition to the battery 11, the controller 12, the heater 13, and the vaporizer 14. For example, the aerosol generating device 1 may include a display capable of outputting visual information and/or a motor for outputting haptic information. Also, the aerosol generating device 1 may include at least one sensor (e.g., a puff detecting sensor, a temperature detecting sensor, a cigarette insertion detecting sensor, etc.). Also, the aerosol generating device 1 may be formed as a structure where, even when the cigarette 2 is inserted into the aerosol generating device 1, external air may be introduced or internal air may be discharged.

Although not illustrated in FIGS. 1 through 3, the aerosol generating device 1 and an additional cradle may form together a system. For example, the cradle may be used to charge the battery 11 of the aerosol generating device 1. Alternatively, the heater 13 may be heated when the cradle and the aerosol generating device 1 are coupled to each other.

The cigarette 2 may be similar to a general combustive cigarette. For example, the cigarette 2 may be divided into a first portion including an aerosol generating material and a second portion including a filter, etc. Alternatively, the second portion of the cigarette 2 may also include an aerosol generating material. For example, an aerosol generating material made in the form of granules or capsules may be inserted into the second portion.

The entire first portion may be inserted into the aerosol generating device 1, and the second portion may be exposed to the outside. Alternatively, only a portion of the first portion may be inserted into the aerosol generating device 1, or the entire first portion and a portion of the second portion may be inserted into the aerosol generating device 1. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 1. For example, opening and closing of the air passage and/or a size of the air passage may be adjusted by the user. Accordingly, the amount and quality of vapor may be adjusted by the user. As another example, the external air may flow into the cigarette 2 through at least one hole formed in a surface of the cigarette 2.

Figure 4A:
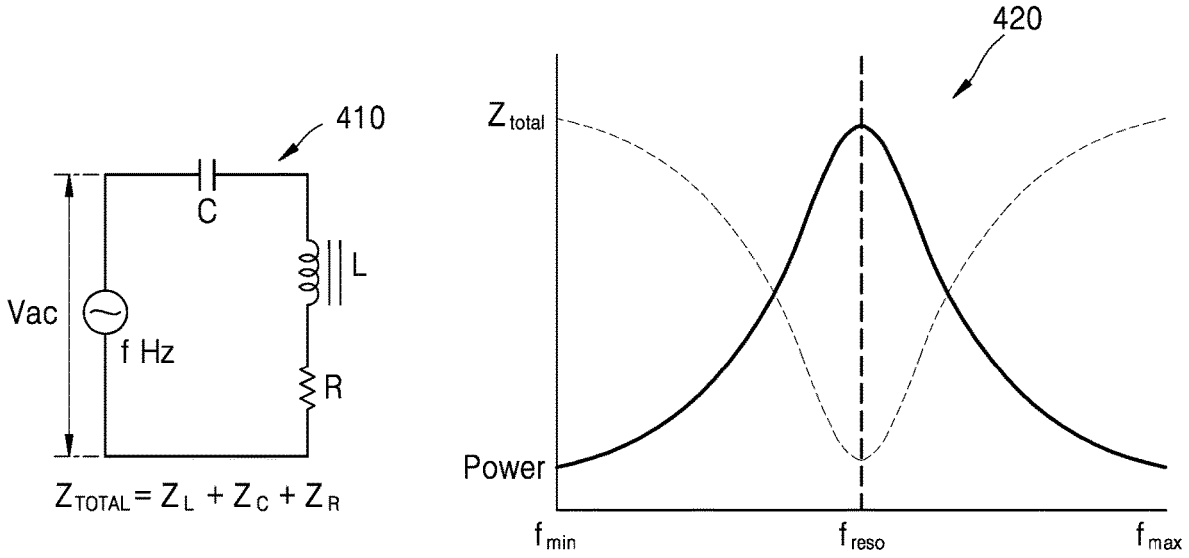
FIGS. 4A and 4B are example views for explaining an induction heating method according to an embodiment.
Figure 4B:
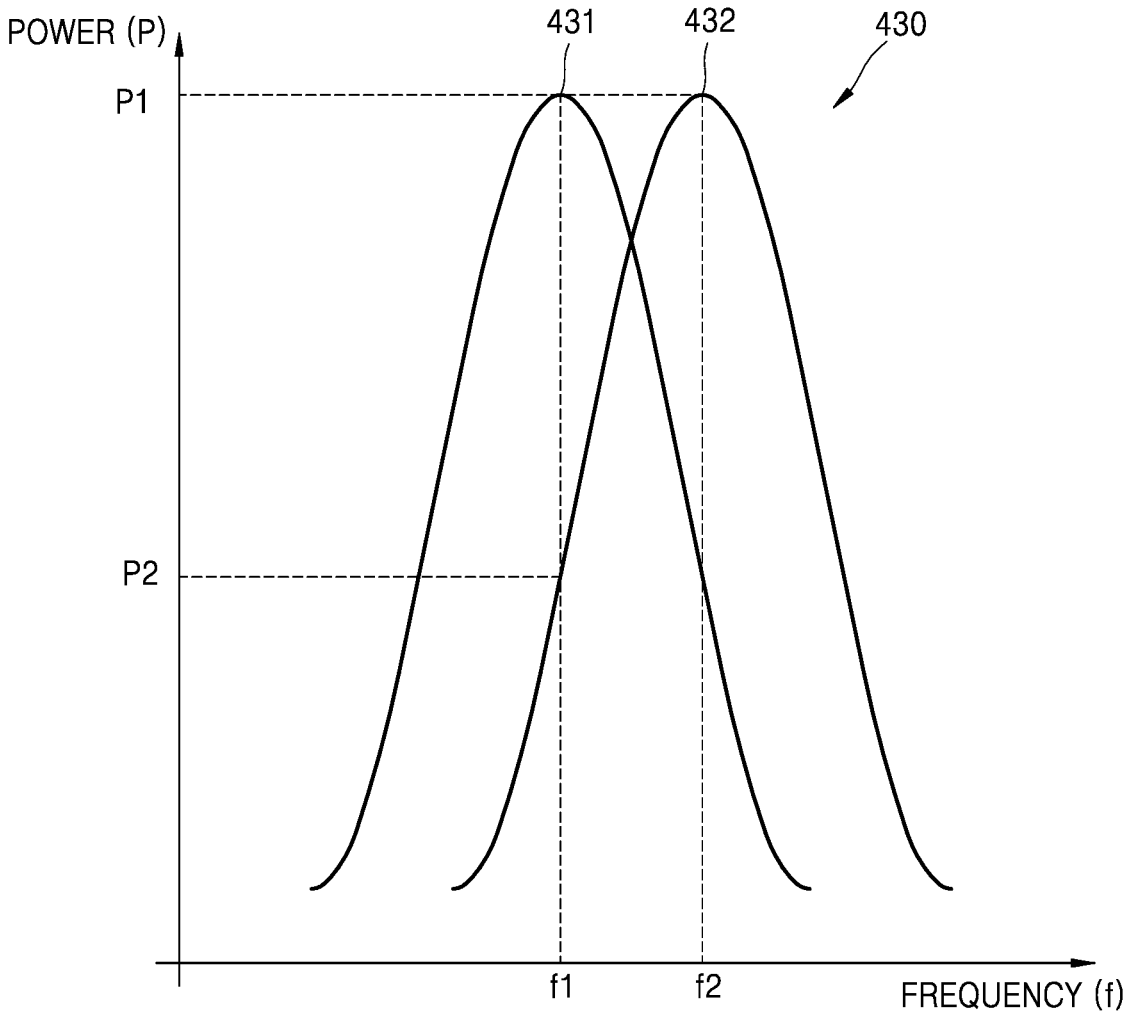

FIGS. 4A and 4B are example views for explaining an induction heating method according to an embodiment.

An induction coil may be supplied with an alternating current from a battery. An alternating magnetic field is generated by the induction coil that is supplied with the alternating current from the battery. As the alternating magnetic field generated by the induction coil passes through a load (e.g., a susceptor), the load may be heated.

Referring to FIG. 4A, the induction coil may be represented by an RLC circuit 410. The RLC circuit 410 includes inductance L, resistance R, and capacitance C. Total impedance $Z_{TOTAL}$ of the RLC circuit 410 is calculated as a sum of impedance $Z_L$ of the inductance L, impedance $Z_R$ of the resistance R, and impedance $Z_C$ of the capacitance C.

The impedance $Z_L$ of the inductance L, the impedance $Z_R$ of the resistance R, and the impedance $Z_C$ of the capacitance C may be respectively expressed as in Equation 1 below.

$$Z_L = \omega L = 2\pi \times f \times L \tag{1}$$

$$Z_C = -\frac{1}{\omega C} = -\frac{1}{2\pi \times f \times C}$$

$$Z_R = R$$

Resonance refers to a phenomenon in which vibration amplitude increases significantly as a vibration system periodically receives external force having the same frequency as a natural frequency thereof. The resonance is a phenomenon that occurs in all vibrations, such as mechanical and electrical vibrations. In general, when external force applied to the vibration system has the same frequency as the natural frequency of the system, the vibration amplitude increases.

As such, when a plurality of vibrating bodies separated within a preset distance vibrate at the same frequency, the plurality of vibrating bodies resonate with each other. In this case, resistance is reduced between the plurality of vibrating bodies.

A resonant frequency freso of the RLC circuit 410 may be determined by, for example, Equation 2 below.

$$f_{reso} = 2\pi\sqrt{\frac{1}{LC}} \tag{2}$$

Referring to a graph 420 of FIG. 4A, when an alternating current having the resonant frequency freso is applied to the RLC circuit 410, maximum power may be transmitted to a load (e.g., a susceptor). As a frequency of an alternating current applied to the RLC circuit 410 is different from the resonant frequency freso, a power value transmitted to the load decreases.

Referring to Equation 2 above, the resonant frequency freso of the RLC circuit 410 is determined by the inductance L and the capacitance C of the induction coil. In a circuit forming a magnetic field by using a coil, inductance L may be determined by the number of windings of the coil and the like, and capacitance C may be determined by a distance, an area, and the like between the windings of the coil.

FIG. 4B illustrates graphs 430 for power values for respective frequencies for two induction coils having different resonant frequencies.

Referring to a graph 431 for a first induction coil, the first induction coil has a resonant frequency f1. Referring to a graph 432 for a second induction coil, the second induction coil has a resonant frequency f2.

When a frequency f1 is applied to the first induction coil and the second induction coil, the first induction coil may resonate to transmit maximum power P1 to a load. However, since the frequency f1 does not correspond to a resonant frequency f2, the second coil may transmit, to the load, power P2 lower than the maximum power P1.

Figure 5A:
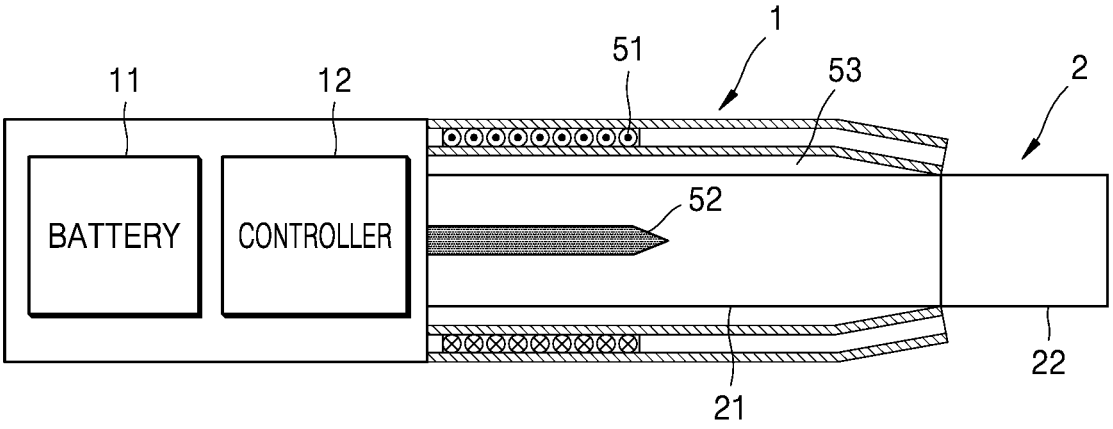
FIGS. 5A and 5B are views illustrating an example of an aerosol generating system using an induction heating method, according to an embodiment.
Figure 5B:
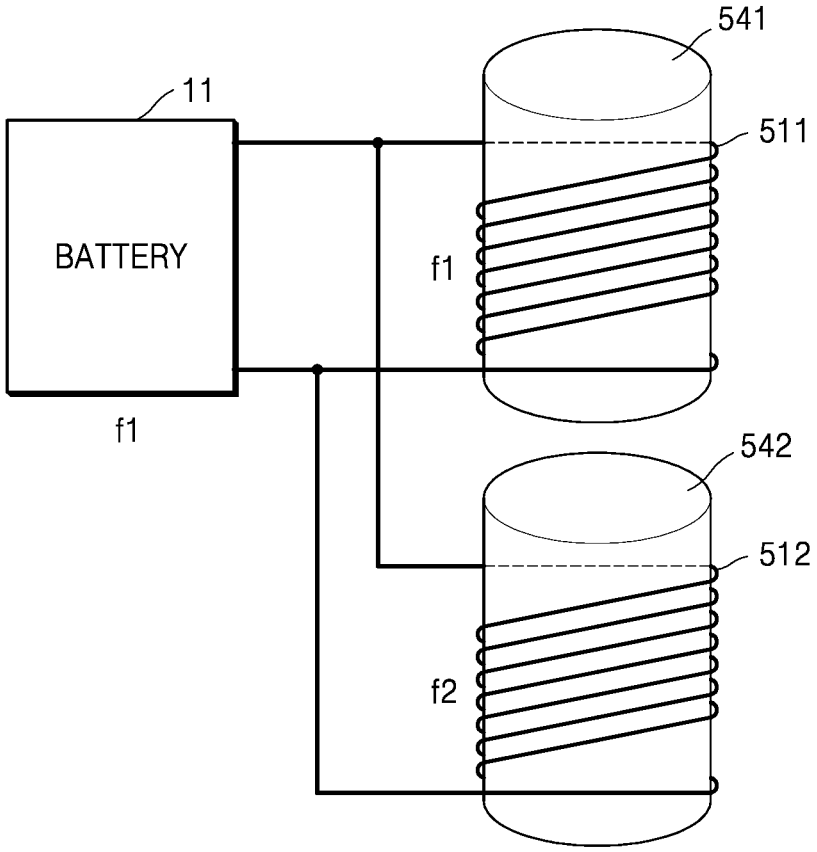

FIGS. 5A and 5B are views illustrating an example of an aerosol generating system using an induction heating method, according to an embodiment.

Referring to FIG. 5A, an aerosol generating device 1 includes a battery 11, a controller 12, an induction coil 51, and a susceptor 52. A cavity 53 of the aerosol generating device 1 may accommodate at least a portion of a cigarette 2.

The aerosol generating device 1 illustrated in FIG. 5A shows elements related to the present embodiment. Therefore, it will be understood by one of ordinary skill in the art related to the present embodiment that the aerosol generating device 1 may further include other elements in addition to the elements illustrated in FIG. 5A.

The induction coil 51 may be located around the cavity 53. FIG. 5A illustrates that the induction coil 51 is arranged to surround the cavity 53 but is not limited thereto.

When the cigarette 2 is accommodated in the cavity 53 of the aerosol generating device 1, the aerosol generating device 1 may supply power to the induction coil 51 such that the induction coil 51 may generate an alternating magnetic field. As the alternating magnetic field generated by the induction coil 51 passes through the susceptor 52, the susceptor 52 may be heated. An aerosol generating material in the cigarette 2 may be heated by the heated susceptor 52 such that aerosol may be generated. The generated aerosol passes through the cigarette 2 and is delivered to a user.

The battery 11 supplies power to be used for the aerosol generating device 1 to operate. For example, the battery 11 may supply power such that the induction coil 51 may generate an alternating magnetic field and may supply power needed for operating the controller 12. Also, the battery 11 may supply power needed for operating a display, a sensor, a motor, and the like installed in the aerosol generating device 1.

The controller 12 controls an overall operation of the aerosol generating device 1. In detail, the controller 12 controls operations of other elements included in the aerosol generating device 1, as well as operations of the battery 11 and the induction coil 51. Also, the controller 12 may determine whether or not the aerosol generating device 1 is in an operable state by checking states of respective elements of the aerosol generating device 1.

The induction coil 51 may be an electrically conductive coil that generates an alternating magnetic field by power supplied from the battery 11. The induction coil 51 may be arranged to surround at least a portion of the cavity 53. The alternating magnetic field generated by the induction coil 51 may be applied to the susceptor 52 arranged at an inner end of the cavity 53.

The susceptor 52 may be heated as the alternating magnetic field generated from the induction coil 51 passes through the susceptor 52 and may include metal or carbon. For example, the susceptor 52 may include at least one of ferrite, a ferromagnetic alloy, stainless steel, and aluminum.

Also, the susceptor 52 may include at least one of graphite, molybdenum, silicon carbide, niobium, a nickel alloy, a metal film, ceramic such as zirconia, transition metal such as nickel (Ni) cobalt (Co), and metalloid such as boron (B) and phosphorus (P). However, the susceptor 52 is not limited to the example described above and may include any other susceptors that may be heated to a desired temperature by an alternating magnetic field applied thereto. Here, the desired temperature may be preset in the aerosol generating device 1 or may be set manually by a user.

When the cigarette 2 is accommodated in the cavity 53 of the aerosol generating device 1, the susceptor 52 may be located inside the cigarette 2. Therefore, the heated susceptor 52 may raise a temperature of the aerosol generating material in the cigarette 2.

FIG. 5A illustrates that the susceptor 52 is inserted into the cigarette 2 but is not limited thereto. For example, the susceptor 52 may include a tube-type heating element, a plate-type heating element, a needle-type heating element or a rod-type heating element and may heat an inside or an outside of the cigarette 2 according to a shape of a heating element.

Also, the aerosol generating device 1 may also include a plurality of susceptors 52 arranged therein. Here, the plurality of susceptors 52 may be arranged to be inserted into the cigarette 2 or may be arranged outside the cigarette 2. Also, some of the plurality of susceptors 52 may be arranged to be inserted into the cigarette 2, and the others may be arranged outside the cigarette 2. In addition, the shape of the susceptor 52 is not limited to the shape illustrated in FIG. 5A and may be formed in various shapes.

Referring to FIG. 5B, a first induction coil 511 and a second induction coil 512 having different resonant frequencies are connected to the battery 11 in parallel.

When the number of windings, a distance, and an area, and the like are constant throughout the induction coil 51, the susceptor 52 may also be heated at a constant temperature throughout.

When the first induction coil 511 and the second induction coil 512 are connected to the battery 11 in parallel as illustrated in FIG. 5B, the first induction coil 511 and the second induction coil 512 may be supplied with an alternating current of the same frequency from the battery 11. Here, when resonant frequencies of the first induction coil 511 and the second induction coil 512 are different, power transmitted to a load from each of the first induction coil 511 and the second induction coil 512 may be different.

For example, the first induction coil 511 may have a resonant frequency f1, and the second induction coil 512 may have a resonant frequency f2. Here, when an alternating current of a frequency f1 is applied to each of the first induction coil 511 and the second induction coil 512 from the battery 11, the first induction coil 511 may transmit maximum power to a first load 541, but the second induction coil 512 may transmit, to a second load 542, power lower than the maximum power.

Resonant frequencies of the first induction coil 511 and the second induction coil 512 may be determined by inductance L and capacitance C. The inductance L may be determined by the number of windings of a coil and the like, and the capacitance C may be determined by a distance, an area, and the like between the windings of the coil.

Figure 6:
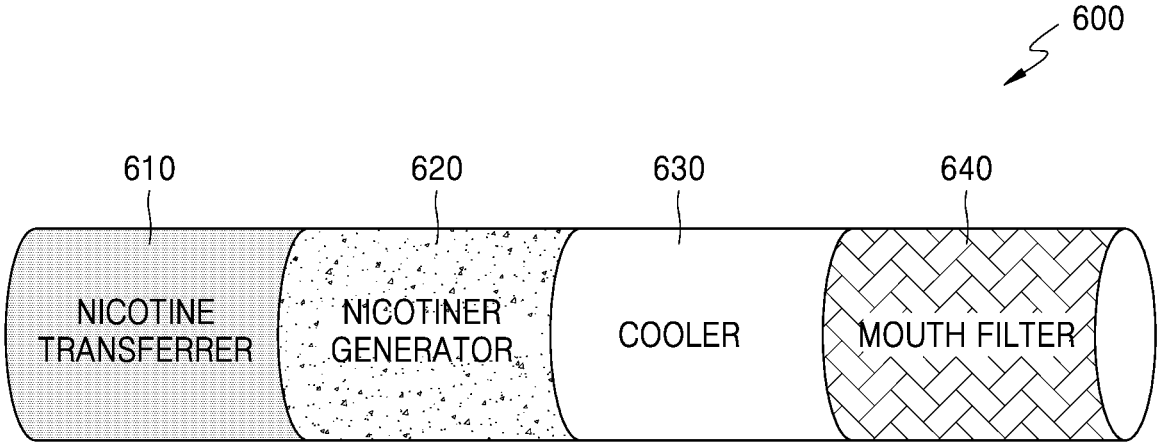
FIG. 6 is a view illustrating an example of a cigarette according to an embodiment.

FIG. 6 is a view illustrating an example of a cigarette according to an embodiment.

Referring to FIG. 6, a cigarette 600 includes a nicotine transferrer 610, a nicotine generator 620, and a filter unit. The filter unit includes a cooler 630 and a mouth filter 640. As needed, the filter unit may further include another segment performing another function.

The nicotine transferrer 610 includes an aerosol generating material. The nicotine transferrer 610 may include at least one of glycerin, propylene glycol, ethylene glycol, dipropylene glycol, diethylene glycol, triethylene glycol, tetraethylene glycol, and oleyl alcohol but is not limited thereto. The nicotine transferrer 610 may be heated such that aerosol may be generated.

The nicotine generator 620 includes a tobacco material including nicotine. The nicotine generator 620 may include a tobacco material such as tobacco leaves, a reconstituted tobacco, and tobacco granules. The nicotine generator 620 may be formed as a sheet, a strand, or a pipe tobacco which is formed of tiny bits cut from a tobacco sheet.

The cooler 630 cools aerosol generated by heating at least one of the nicotine transferrer 610 and the nicotine generator 620. Therefore, a user may puff the aerosol at an appropriate temperature.

In an embodiment, the cooler 630 may be a hollow-type cellulose acetate filter. In another embodiment, the cooler 630 may be a filter formed of a polymer fiber. The cooler 630 may be formed of a woven polymer fiber or a crimped polymer sheet. For example, the polymer may be formed of a material selected from the group consisting of polyethylene (PE), polypropylene (PP), polyvinyl chloride (PVC), polyethylene terephthalate (PET), polylactic acid (PLA), cellulose acetate (CA), and aluminum foil.

The mouth filter 640 may be a cellulose acetate filter.

The mouth filter 640 may be a cylindrical type or a tube type having a hollow inside. Also, the mouth filter 640 may be a recessed type.

In addition, the mouth filter 640 may include at least one capsule. Here, the capsule may generate a flavor and/or aerosol. For example, the capsule may have a configuration in which a liquid including a flavoring material is wrapped with a film. The capsule may have a spherical or cylindrical shape but is not limited thereto.

The aerosol generated by the nicotine transferrer 610 and the nicotine generator 620 is cooled by passing through the cooler 630, and the cooled aerosol is delivered to the user through the mouth filter 640. Therefore, when a flavoring element is added to the mouth filter 640, the persistence of flavors delivered to the user may be enhanced.

Although not illustrated in FIG. 6, the cigarette 600 may be packaged by at least one wrapper. The wrapper may have at least one hole through which external air may be introduced or internal air may be discharged. As an example, the cigarette 600 may be packaged by one wrapper. As another example, the cigarette 600 may be double-packaged via two or more wrappers.

Figure 7A:
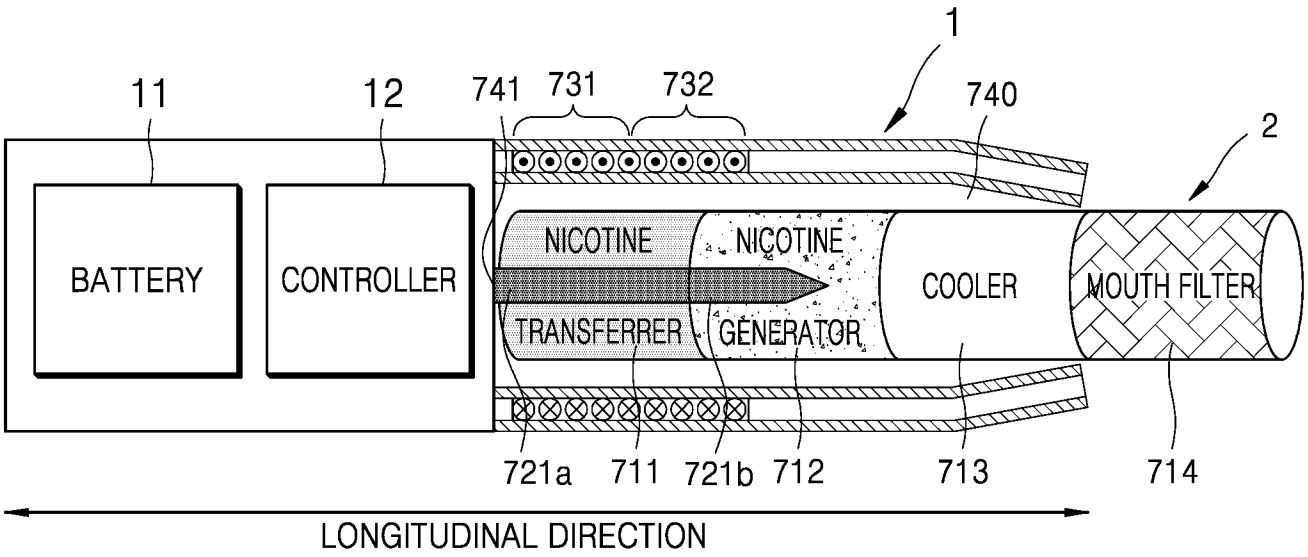
FIGS. 7A and 7B are views illustrating an example of an aerosol generating system including a plurality of induction coils, according to an embodiment.
Figure 7B:
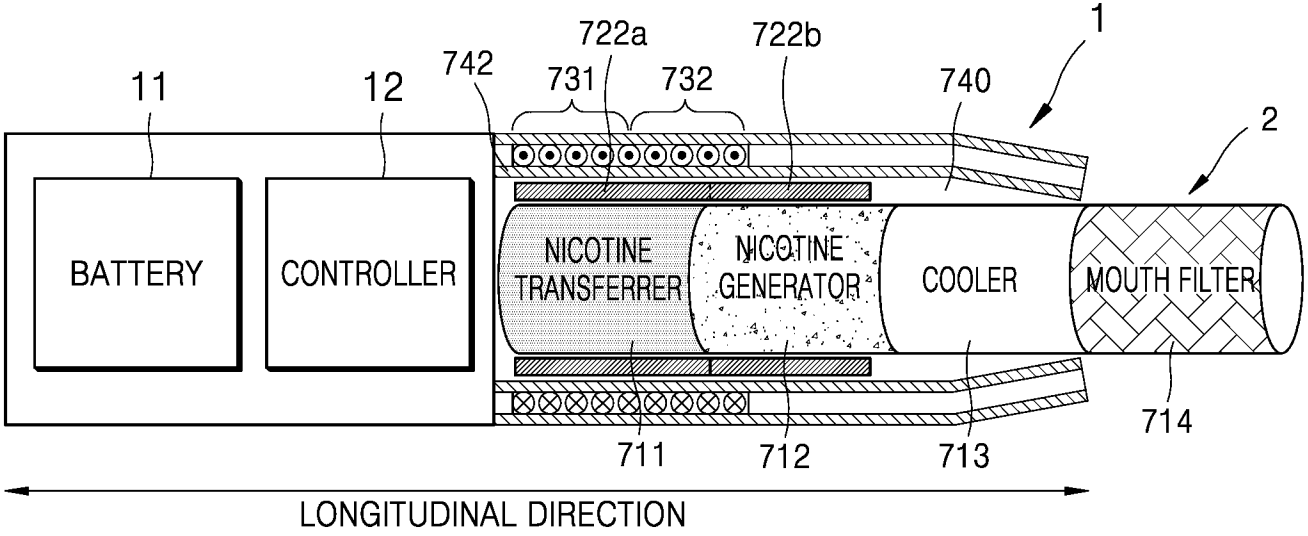

FIGS. 7A and 7B are views illustrating an example of an aerosol generating system including a plurality of induction coils, according to an embodiment.

The aerosol generating system includes an aerosol generating device 1 and a cigarette 2.

The aerosol generating device 1 may include a battery 11, a controller 12, a first induction coil 731, a second induction coil 732, a susceptor, and a cavity 740. The cigarette 2 may include a nicotine transferrer 711, a nicotine generator 712, a cooler 713, and a mouth filter 714. However, it will be understood by one of ordinary skill in the art related to the present embodiment that other elements may be further included in addition to the elements illustrated in FIGS. 7A and 7B.

When the cigarette 2 is accommodated in the cavity 740 of the aerosol generating device 1, the aerosol generating device 1 may supply power to the first induction coil 731 and the second induction coil 732 from the battery 11 such that the first induction coil 731 and the second induction coil 732 may generate an alternating magnetic field. As the alternating magnetic field generated by the first induction coil 731 and the second induction coil 732 passes through the susceptor, the susceptor may heat the nicotine transferrer 711 and the nicotine generator 712.

The first induction coil 731 and the second induction coil 732 may be connected to the battery 11 (and/or the controller 12) in parallel. The first induction coil 731 and the second induction coil 732 may be supplied with an alternating current of the same frequency from the battery 11. Here, if resonant frequencies of the first induction coil 731 and the second induction coil 732 are different, power transmitted to the susceptor from each of the first induction coil 731 and the second induction coil 732 may be different.

FIG. 7A illustrates an aerosol generating system including an elongated susceptor 721*a* and 721*b*.

The susceptor 721*a* and 721*b* may be part of the aerosol generating device 1. The susceptor 721*a* and 721*b* may extend along a longitudinal direction of the cavity 740 from a support portion 741 formed at an inner end of the cavity 740.

The cigarette 2 may include the nicotine transferrer 711 and the nicotine generator 712 connected to a downstream end of the nicotine transferrer 711.

The nicotine transferrer 711 may include a moisturizer (e.g., glycerin, propylene glycol, or the like), and aerosol may be generated as the nicotine transferrer 711 is heated. The nicotine generator 712 includes a tobacco material (e.g., tobacco leaves, a reconstituted tobacco, tobacco granules, or the like) including nicotine, and nicotine is generated as the nicotine generator 712 is heated.

Since materials included in the nicotine transferrer 711 and the nicotine generator 712 are different, heating temperatures of the nicotine transferrer 711 and the nicotine generator 712 for proving a user with a best tobacco taste may be different.

When the cigarette 2 is accommodated in the cavity 740 of the aerosol generating device 1, the susceptor 721*a* and 721*b* is inserted into the cigarette 2. In this case, a first portion 721*a* of the susceptor may be located inside the nicotine transferrer 711, and a second portion 721*b* of the susceptor may be located inside the nicotine generator 712.

The first induction coil 731 and the second induction coil 732 may be connected to the battery 11 in parallel. In this case, the first induction coil 731 and the second induction coil 732 may be supplied with an alternating current of the same frequency from the battery 11.

A resonant frequency of each of the first induction coil 731 and the second induction coil 732 is determined by inductance L and capacitance C. The inductance L may be determined the number of windings of a coil, and the capacitance C may be determined by a distance, an area, and the like between the windings of the coil.

Since the first induction coil 731 and the second induction coil 732 have different resonant frequencies, a heating temperature of the first portion 721*a* of the susceptor corresponding to the first induction coil 731 and a heating temperature of the second portion 721*b* of the susceptor corresponding to the second induction coil 732 may be different.

Also, since the first portion 721*a* of the susceptor heats the nicotine transferrer 711, and the second portion 721*b* of the susceptor heats the nicotine generator 712, heating temperatures of the nicotine transferrer 711 and the nicotine generator 712 may be different.

A temperature at which the first portion 721*a* of the susceptor heats the nicotine transferrer 711 may be about 30° C. to about 100° C. higher than a temperature at which the second portion 721*b* of the susceptor heats the nicotine generator 712. Alternatively, the temperature at which the first portion 721*a* of the susceptor heats the nicotine transferrer 711 may be about 50° C. to about 80° C. higher than the temperature at which the second portion 721*b* of the susceptor heats the nicotine generator 712.

For example, the nicotine transferrer 711 may be heated at a temperature of about 180° C. to about 250° C. by the first portion 721*a* of the susceptor, and the nicotine generator 712 may be heated at a temperature of about 150° C. to about 200° C. by the second portion 721*b* of the susceptor.

However, the best heating temperatures of the nicotine transferrer 711 and the nicotine generator 712 may vary according to a type, a composition ratio, and the like of a material constituting each segment.

The susceptor 721*a* and 721*b* may be part of the cigarette 2. The susceptor 721*a* and 721*b* may be included inside the nicotine transferrer 711 and the nicotine generator 712 of the cigarette 2. The susceptor 721*a* and 721*b* may extend along a longitudinal direction of the cigarette 2.

When the susceptor 721*a* and 721*b* is included in the cigarette 2, the first portion 721*a* of the susceptor and the second portion 721*b* of the susceptor may be connected to each other to form a single heating body or may be separated from each other to be respectively located inside the nicotine transferrer 711 and the nicotine generator 712.

FIG. 7B illustrates an aerosol generating system including a cylindrical susceptor 722*a* and 722*b*.

Hereinafter, for convenience of description, the same description of FIG. 7B as that of FIG. 7A will be omitted.

The susceptor 722*a* and 722*b* may be part of an aerosol generating device 1. The susceptor 722*a* and 722*b* may extend in a longitudinal direction of a cavity 740 along an inner wall 742 forming the cavity 740.

When a cigarette 2 is accommodated in the cavity 740 of the aerosol generating device 1, the susceptor 722*a* and 722*b* may be located to surround an outside of the cigarette 2. Here, a first portion 722*a* of the susceptor may be located at a position corresponding to a transferrer 711, and a second portion 722*b* of the susceptor may be located at a position corresponding to a nicotine generator 712.

To heat the nicotine transferrer 711 and the nicotine generator 712 at different temperatures, heating temperatures of the first portion 722*a* of the susceptor and the second susceptor 722*b* of the susceptor may be set differently.

When a first induction coil 731 and a second induction coil 732 having different resonant frequencies are connected to a battery 11 in parallel and supplied with an alternating current of the same frequency from the battery 11, the heating temperature of the first portion 722*a* of the susceptor corresponding to the first induction coil 731 and the heating temperature of the second portion 722*b* of the susceptor corresponding to the second induction coil 732 may be different.

As a result, since the first portion 722*a* of the susceptor heats the nicotine transferrer 711, and the second portion 722*b* of the susceptor heats the nicotine generator 712, heating temperatures of the nicotine transferrer 711 and the nicotine generator 712 may also be different.

The susceptor 722*a* and 722*b* may be part of the cigarette 2. The susceptor 722*a* and 722*b* may be located on an outer surface of the cigarette 2 to extend along a longitudinal direction of the cigarette 2. For example, the first portion 722*a* of the susceptor and the second portion 722*b* of the susceptor may be located to respectively surround the nicotine transferrer 711 and the nicotine generator 712. Also, the susceptor (722*a* and 722*b*) may be packaged by at least one wrapper.

When the first portion 722*a* of the susceptor and the second portion 722*b* of the susceptor are part of the cigarette 2, the first portion 722*a* of the susceptor and the second portion 722*b* of the susceptor may be connected to each other to form a single heating body or may be separated from each other to be respectively located at positions corresponding to the nicotine transferrer 711 and the nicotine generator 712.

Figure 8:
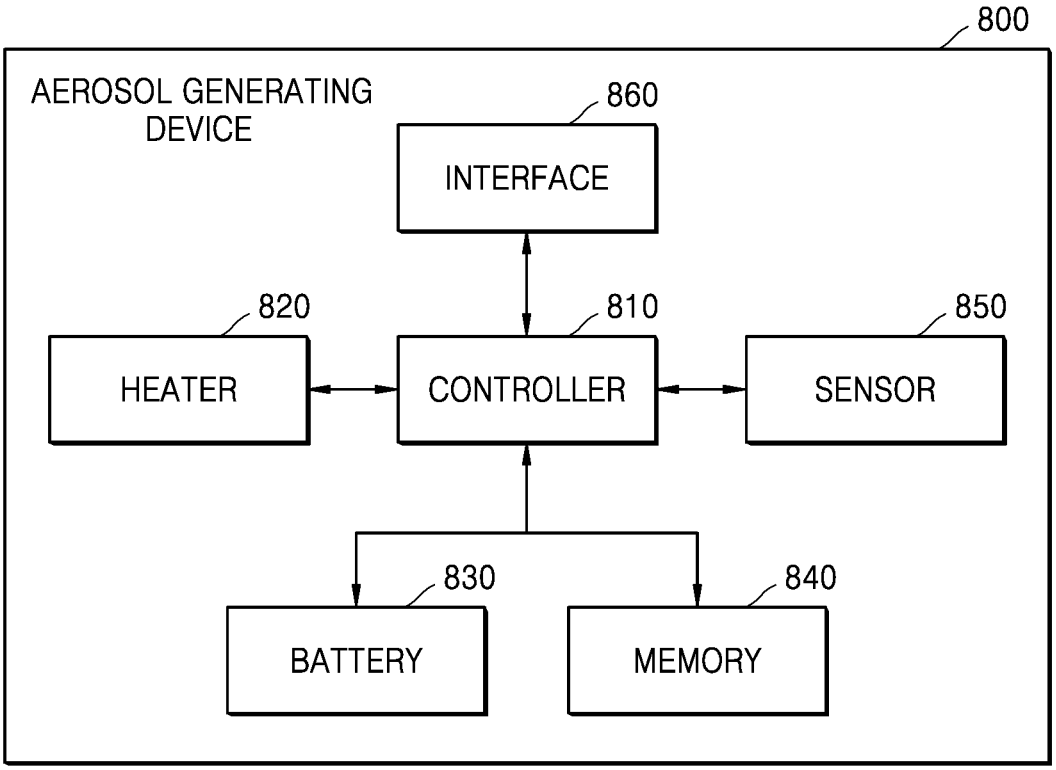
FIG. 8 is a block diagram illustrating a hardware configuration of an aerosol generating device according to an embodiment.

FIG. 8 is a block diagram illustrating a hardware configuration of an aerosol generating device, according to an embodiment.

Referring to FIG. 8, an aerosol generating device 800 may include a controller 810, a heater 820, a battery 830, a memory 840, a sensor 850, and an interface 860. However, an internal structure of the aerosol generating device 800 is not limited to the example illustrated in FIG. 8. One of ordinary skill in the art related to the present embodiment will understand that, according to a design of the aerosol generating device 800, some of the hardware configuration illustrated in FIG. 8 may be omitted or new elements may be further added.

The heater 820 is electrically heated by power supplied from the battery 830 under control of the controller 810. The heater 820 is located inside an accommodation passage of the aerosol generating device 800 accommodating a cigarette. As the cigarette is inserted through an insertion hole of the aerosol generating device 800 from the outside and then moves along the accommodation passage, one end of the cigarette may be inserted into the heater 820. Therefore, the heated heater 820 may raise a temperature of an aerosol generating material in the cigarette. The heater 820 may include any heaters that may be inserted into a cigarette.

The heater 820 may include a heat source and a heat transfer object. For example, the heat source of the heater 820 may be manufactured in a film shape having an electro-resistive pattern, and the film-shaped heater 820 may be arranged to surround at least a portion of an outer surface of the heat transfer object (e.g., a heat transfer tube).

The heat transfer object may include a metal material capable of transferring heat, such as aluminum or stainless steel, an alloy material, carbon, a ceramic material, or the like. When power is supplied to the electro-resistive pattern of the heater 820, heat may be generated, and the generated heat may heat the aerosol generating material through the heat transfer object.

The aerosol generating device 800 may include an additional temperature detecting sensor. Alternatively, instead of including the additional temperature detecting sensor, the heater 820 may function as a temperature detecting sensor. Alternatively, while the heater 820 functions as a temperature detecting sensor, the aerosol generating device 800 may further include an additional temperature detecting sensor. A temperature detecting sensor may be arranged on the heater 820 in the form of a conductive track or element.

For example, when a voltage across the temperature detecting sensor and a current flowing through the temperature detecting sensor are measured, resistance R may be determined. Here, the temperature detecting sensor may measure a temperature T by Equation 3 below:

$$R=R_0\{1+\alpha(T-T_0)\} \quad (3)$$

wherein R denotes a current resistance value of the temperature detecting sensor, R0 denotes a resistance value at a temperature TO (e.g., 0° C.), and a denotes a resistance temperature coefficient of the temperature detecting sensor. Since a conductive material (e.g., metal) has a unique resistance temperature coefficient, a: may be preset according to a conductive material constituting the temperature detecting sensor. Therefore, once the resistance R of the temperature detecting sensor is determined, a temperature T of the temperature detecting sensor may be calculated by Equation 3 above.

The controller 810 is hardware controlling an overall operation of the aerosol generating device 800. The controller 810 is an integrated circuit that is embodied as a processing unit such as a microprocessor and a microcontroller.

The controller 810 analyzes a sensing result from the sensor 850 and controls processes to be subsequently performed. The controller 810 may start or stop supplying power from the battery 830 to the heater 820 according to the sensing result. Also, the controller 810 may control the amount of power supplied to the heater 820 and a time when power is supplied to the heater 820 such that the heater 820 may be heated to a preset temperature or may maintain an appropriate temperature. In addition, the controller 810 may process various types of input information and output information of the interface 760.

The controller 810 may control smoking-related functions of the aerosol generating device 800 to count the number of puffs on the aerosol generating device 800 and limit the smoking of the user according to the counting result.

The memory 840 may be hardware storing various types of data processed in the aerosol generating device 800. The memory 840 may store pieces of data processed by the controller 810 and pieces of data to be processed by the controller 810. The memory 840 may be embodied as various types, such as random access memory (RAM) such as dynamic random access memory (DRAM) and static random access memory (SRAM), read-only memory (ROM), and electrically erasable programmable read-only memory (EEPROM).

The memory 840 may store data about a smoking pattern of the user such as a smoking time and the number of smoking. Also, the memory 840 may store data related to a change of a reference temperature when the cigarette is accommodated in the accommodation passage.

In addition, the memory 840 may store a plurality of temperature correction algorithms.

The battery 830 supplies power to be used for the aerosol generating device 800 to operate. In other words, the battery 830 may supply power such that the heater 820 may be heated. Also, the battery 830 may supply power needed for operations of other pieces of hardware, the controller 810, the sensor 850, and the interface 860 provided in the aerosol generating device 800. The battery 830 may be a lithium iron phosphate (LiFePO4) battery but is not limited thereto, and thus may be formed as a lithium cobalt oxide (LiCoO2) battery, a lithium titanate battery, or the like. The battery 830 may be a rechargeable battery or a disposable battery.

The sensor 850 may include various types of sensors such as a puff detecting sensor (e.g., a temperature detecting sensor, a flow detecting sensor, a position detecting sensor, or the like), a cigarette insertion detecting sensor, a temperature detecting sensor of the heater 820, and a cigarette reuse detecting sensor. A sensing result of the sensor 850 may be transmitted to the controller 810, and the controller 810 may control the aerosol generating device 800 to thereby perform various functions, such as controlling a heater temperature, limiting smoking, determining whether or not a cigarette is inserted, displaying a notification, and determining whether or not the cigarette is reused, according to the sensing result.

The interface 860 may include various types of interfacing elements such as a display or lamp outputting visual information, a motor outputting tactile information, a speaker outputting sound information, input/output (I/O) interfacing elements (e.g., a button and a touch screen) receiving information input from the user or outputting information to the user, terminals performing data communication or supplied with charging power, and a communication interfacing module performing wireless communication (e.g., WI-FI, WI-FI Direct, Bluetooth, Near-Field Communication (NFC), or the like) with an external device. However, the aerosol generating device 800 may be embodied by selecting merely some of various types of interfacing elements illustrated above.

The aerosol generating device 800 may further include a vaporizer (not shown). The vaporizer may include a liquid storage, a liquid delivery element, and a heating element heating a liquid.

The liquid storage may store a liquid composition. For example, the liquid composition may be a liquid including a tobacco-including material having a volatile tobacco flavor component or a liquid including a non-tobacco material. The liquid storage may be formed to be detachable from the vaporizer or may be formed integrally with the vaporizer.

For example, the liquid composition may include water, a solvent, ethanol, plant extract, spices, flavorings, or a vitamin mixture. The spices may include menthol, peppermint, spearmint oil, and various fruit-flavored ingredients but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer may be referred to as a cartomizer or an atomizer but is not limited thereto.

At least one of the components, elements, modules or units (collectively "components" in this paragraph) represented by a block in the drawings such as the controller 12, the input interface 16, and the interface 860 in FIGS. 1, 2, 7A, 7B, and 8, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

The invention claimed is:

1. An aerosol generating system comprising:

a cavity configured to accommodate at least a portion of a cigarette;

a first induction coil located around the cavity;

a second induction coil located around the cavity and connected to the first induction coil in parallel;

a battery configured to supply an alternating current to the first induction coil and the second induction coil;

a susceptor configured to be heated by magnetic fields formed by the first induction coil and the second induction coil;

a controller; and the cigarette, wherein the first induction coil and the second induction coil have different resonant frequencies, wherein the cigarette comprises a nicotine transferrer configured to be heated by a first portion of the susceptor corresponding to the first induction coil and a nicotine generator configured to be heated to a lower temperature than the nicotine transferrer by a second portion of the susceptor corresponding to the second induction coil, and wherein the controller is configured to supply an alternating current of a same frequency to the first induction coil and the second induction coil from the battery when the cigarette is accommodated in the cavity.

2. The aerosol generating system of claim 1, wherein at least one of inductance and capacitance is different between the first induction coil and the second induction coil.

3. The aerosol generating system of claim 1, wherein the nicotine transferrer comprises an aerosol generating material, the nicotine generator comprises a tobacco material, and the nicotine generator is connected to a downstream end of the nicotine transferrer, and the cigarette further comprises a filter connected to a downstream end of the nicotine generator.

4. The aerosol generating system of claim 1, wherein a temperature at which the first portion of the susceptor heats the nicotine transferrer is about 30° C. to about 100° C. higher than a temperature at which the second portion of the susceptor heats the nicotine generator.

5. The aerosol generating system of claim 4, wherein the nicotine transferrer is heated at about 180° C. to about 250° C., and the nicotine generator is heated at about 150° C. to about 200° C.

6. The aerosol generating system of claim 3, wherein the filter comprises:

a cooler connected to a downstream end of the nicotine generator; and a mouth filter connected to a downstream end of the cooler.

7. The aerosol generating system of claim 1, further comprising a support portion formed at an inner end of the cavity, wherein the susceptor has an elongated shape extending in a longitudinal direction of the cavity from the support portion.

8. The aerosol generating system of claim 1, further comprising an inner wall forming the cavity, wherein the susceptor has a cylindrical shape extending along the inner wall in a longitudinal direction of the cavity.

9. The aerosol generating system of claim 1, wherein the susceptor is included in the cigarette and has an elongated shape extending in a longitudinal direction of the cigarette.

10. The aerosol generating system of claim 1, wherein the susceptor has a cylindrical shape extending in a longitudinal direction of the cigarette and located on an outer surface of the cigarette.

11. An aerosol generating device comprising:

a first induction coil;

a second induction coil connected to the first induction coil in parallel;

a battery configured to supply an alternating current to the first induction coil and the second induction coil;

a susceptor configured to be heated by magnetic fields formed by the first induction coil and the second induction coil;

a controller; and a cigarette, wherein the first induction coil and the second induction coil have different resonant frequencies, and wherein the controller is configured to supply an alternating current of a same frequency to the first induction coil and the second induction coil from the battery when the cigarette is accommodated in a cavity, so that a nicotine transferrer of the cigarette is heated by a first portion of the susceptor corresponding to the first induction coil and a nicotine generator of the cigarette is heated to a lower temperature than the nicotine transferrer by a second portion of the susceptor corresponding to the second induction coil.

12. The aerosol generating device of claim 11, wherein at least one of inductance and capacitance is different between the first induction coil and the second induction coil.

* * * * *